US007246891B2

(12) United States Patent
Qingguo et al.

(10) Patent No.: US 7,246,891 B2
(45) Date of Patent: Jul. 24, 2007

(54) INK CARTRIDGE FOR A PRINTER

(75) Inventors: Xiao Qingguo, Guangdong (CN); Li Yu, Nanping Technological Industries Park (CN)

(73) Assignee: Print-Rite Unicorn Image Products, Co., Ltd., Nanping Technological Industries Park (CN)

( * ) Notice: Subject to any disclaimer, the term of this patent is extended or adjusted under 35 U.S.C. 154(b) by 332 days.

(21) Appl. No.: 10/493,992

(22) PCT Filed: Oct. 15, 2002

(86) PCT No.: PCT/CN02/00723

§ 371 (c)(1),
(2), (4) Date: Oct. 25, 2004

(87) PCT Pub. No.: WO03/037634

PCT Pub. Date: May 8, 2003

(65) Prior Publication Data

US 2005/0068387 A1 Mar. 31, 2005

(30) Foreign Application Priority Data

Oct. 31, 2001 (CN) ..... 01 2 65494
Dec. 11, 2001 (CN) ..... 01 1 42340
May 23, 2002 (CN) ..... 02 1 15259

(51) Int. Cl.
*B41J 2/175* (2006.01)

(52) U.S. Cl. ..... 347/86

(58) Field of Classification Search ..... 347/7, 347/85, 86, 87
See application file for complete search history.

(56) References Cited

U.S. PATENT DOCUMENTS 5,812,168 A * 9/1998 Pawlowski et al. ..... 347/92
5,852,459 A * 12/1998 Pawlowski et al. ..... 347/86
6,145,972 A * 11/2000 Udagawa et al. ..... 347/86
6,193,364 B1 * 2/2001 Iida ..... 347/86
6,361,136 B1 * 3/2002 Watanabe et al. ..... 347/7

FOREIGN PATENT DOCUMENTS

CN 1252353 A 10/2000

OTHER PUBLICATIONS

PCT/CN02/00723 International Search Report, Jan. 15, 2003, China State Intellectual Property Office.

* cited by examiner

*Primary Examiner*—Anh T. N. Vo
(74) *Attorney, Agent, or Firm*—Fay Sharpe LLP

(57) ABSTRACT

The ink cartridge comprises a cartridge body with an ink chamber. On one side of the cartridge body is provided an ink supply port, and an air channel is positioned on the opposite side. The ink chamber is composed of a main chamber and a communicating sub-chamber, and ink-out inspection prism being provided close to the communicating portion. A check valve through which the sub-chamber is communicated with the ink supply port is provided sideways between the sidewalls adjacent to the ink supply port. In this invention, the nominal volume of each ink cartridge is increased, and there is no such problem that a certain amount of ink continues to be fed after the ink-out indicative signal being sent out in case of no porous material. Further, the technical solution of the sideways-provided check valve improves the manufacturability and the ink supply stability.

17 Claims, 9 Drawing Sheets

INK CARTRIDGE FOR A PRINTER

FIELD OF INVENTION

The present invention relates to an ink supply device used in an inkjet recording apparatus, in particular, to an ink cartridge used in an inkjet printer.

BACKGROUND ART

The publication of the Chinese patent application CN1252353A discloses an invention named by "Ink tank, assembly and printing device using the assembly", the structure of the ink cartridge thereof has been described by an embodiment shown in FIG. 5 of CN1252353A. This ink cartridge is a type of the one having two chambers, an ink absorbent material, an ink supply port, and an air hole communicated with the atmosphere are provided in one chamber. The other chamber is a liquid storing chamber that is substantially closed. These two chambers are communicated with each other through a channel formed near the bottom portion of a partition wall. As the print head consumes the ink absorbed by the ink absorbent material, ink in the liquid storing chamber will be supplied to the ink absorbent material through the communicating channel between these two chambers. When the negative pressure in the liquid storing chamber has increased gradually during the ink supply, air then comes from the air hole and through the ink absorbent material will be supplied into the liquid storing chamber via the communicating channel, as a result of which the negative pressure in the liquid storing chamber will decrease, forming a substantially constant negative pressure applied to the print head. Therefore, ink supplied to the print head is kept stable. Furthermore, at the bottom of the liquid storing chamber, there is a triangular prism having a shape of an isosceles triangle whose apical angle is 90°. This prism together with a photoelectric device in the printer constitute an ink-out detection mechanism, the detecting principle of which is as follows: when the ink cartridge is sufficiently filled with ink, once the incident light comes to a plane that contains one oblique portion of the triangle, it will refract into the ink and be absorbed by the ink, so there may not any light signal received by a photoreceptor; when ink is consumed to be below the refracting point of the prism, the incident light will be reflected twice respectively by two planes that contain two oblique portions of the triangle respectively, and then comes to the photoreceptor parallelly, after the photoreceptor has received the light signal, the printer will send an ink-out indicative signal.

It should be pointed out that, sending the ink-out indicative signal by the printer only means that there is not any ink in the liquid storing chamber, while the other chamber still has a certain amount of ink because of the capillary action of the ink absorbent material therein. Therefore, even having received the ink-out indicative signal, a user still may continue to print for a certain amount. This offers an advantage to the printer user that he may deal with the subsequent printing operation. For example, after having received the ink-out signal, the user may continue to print numbers of the standard sheets in general. If the page numbers to be printed are beyond this number, it will be preferable to replace the ink cartridge, so as to avoid doing it at the midcourse of printing on several pages.

Furthermore, the present applicant once developed an ink cartridge, which mainly consists of: a gasbag assembly, which is made up of a cartridge body, a cap, a gasbag seating, a gasbag and an elastic retainer ring; a check valve assembly, which is made up of a valve cap, a valve body and a filter; and a sealing ring disposed in the ink supply port, the moving direction or the center line of the valve body is parallel with the center line of the ink supply port.

The most serious problem about the ink cartridge that takes the first structure described above is that the ink amount contained in each ink cartridge is relatively low. The ink absorbent material generally makes use of a sponge, which will occupy most volume of the chamber, so the volume used for storing ink becomes small relatively.

The cartridge taking the second structure described above has been used in some types of the printers and has achieved a good effect for ink supply. But with regard to some high-speed inkjet printers, in which the ink cartridge and the print head move back and forth simultaneously with a high speed, the acceleration at the turn-back point may be extremely high. In this case, the periphery of the valve body whose centerline is perpendicular to its moving direction will be subject to the inertia effect. The valve body made of rubber has a certain length in the axial direction, so a hole on the valve body will lose its stability and deform under the inertia effect applied to its periphery. Although this deformation can recover immediately after the inertia force has disappeared, there is still a certain amount of ink passing through the check valve, which ought to be in close state, during the deformation and the recovery. This will result in the ink to be excessively supplied, decreasing the printing quality.

Furthermore, with respect to some types of the printers, such as a color inkjet printer using five color cartridges, the chamber of the cartridge is so narrow that the dimension needed to dispose the check valve in a certain direction is smaller or slightly larger than the minimum dimension required for mounting the valve assembly, thus causing this ink cartridge not able to be assembled or causing the assembling to become difficult. Accordingly, assembling the ink cartridge equipped with the check valve in a narrow ink chamber will decrease the pass rate of products.

In addition, the ink cartridge using a check valve to control the ink supply has a certain space between an outlet of the check valve and the ink supply port. Generally, in order to prevent the ink from volatilizing, the ink supply port of an unused ink cartridge is always sealed with a sealing membrane or a sealing cap. However, with respect to some types of the printers that employ an ink supply needle to pierce the sealing membrane and to come into the ink supply port, when the ink supply needle is coming into the space described above, the ink in this space will be probably subject to an instant extrusion because of the reverse cut-off provided by the check valve. As a result of this, the ink will drop out along with the ink supply needle, contaminating the printer or the printing medium. Furthermore, when the ink cartridges are produced by a negative pressure ink-filling method, this space can not draw the negative pressure from the ink supply port located in the cartridge cap, causing the ink not to be filled or to be insufficiently filled into this space. Some printers with print heads having small self-sucking force will occur such a phenomenon during use that the ink is discontinuously supplied.

SUMMARY OF THE INVENTION

A major aim of the present invention is to design a structure of the ink cartridge that may eliminate the sponge. Thus, by the preconditions of substantially ensuring a constant negative pressure and the ink supply quality, a nominal capacity of each ink cartridge may be increased.

Another aim of the present invention is to obtain such an ink cartridge that it may continue to supply a certain amount of ink after an ink-out indicative signal has been sent, even when there is no sponge in the ink chamber.

Still another aim of the present invention is to solve the assembling problem encountered when a check valve is being assembled into a narrow ink chamber, and to improve the work stability of the check valve assembly.

Still another aim of the present invention is to solve an ink dropping problem probably occurred instantly when the ink cartridge employing the check valve is being installed on a printer, and to improve the ink filling manufacturability during manufacturing this type of ink cartridge.

In order to achieve the aims described above, the present invention adopts a cartridge body having an ink chamber. An ink supply port is provided on one side of the cartridge body, and a passage communicated with atmosphere is arranged on the cartridge body, preferably on the opposite side relative to the ink supply port. In order to keep the negative pressure in the ink chamber substantially constant during ink supply, a check valve whose inlet and outlet are communicated with the ink chamber and the ink supply port respectively is disposed offset in the cartridge body. In order that there is still a certain amount of ink left for printing until the ink is exhausted even after the ink-out indicative signal has been received, the ink chamber is divided into a main chamber and a sub-chamber theoretically. An ink-out detecting prism is arranged adjacent to a communicating part between the main chamber and the sub-chamber, which is communicated with the inlet of the check valve. The ink supply procedure of this ink cartridge is as follows: the check valve is opened under the self-sucking force provided by the print head, and then the ink in the sub-chamber is supplied through the valve and the ink supply port. During this course, the sub-chamber supplies ink to the print head through the check valve in one hand, and on the other hand, ink is supplied from the main chamber through the communicating part to the sub-chamber, so the ink level in the sub-chamber will not lower. When ink in the main chamber is exhausted, in other words, when only the sub-chamber is fully filled with ink, the ink-out detecting device will send an ink-out indicative signal. Then the sub-chamber will continue supplying ink to print a certain amount of print sheets.

Another technical solution of the present invention is as follows: a cartridge body having an ink chamber is provided. An ink supply port in which an ink-guiding member is disposed is provided on one side of the cartridge body. A passage communicated with atmosphere is arranged on the cartridge body, preferably on the opposite side relative to the ink supply port. The ink chamber is comprised of a main chamber and a sub-chamber communicating with each other. An ink-out detecting prism is disposed adjacent to the communicating part between the main chamber and the auxiliary one. A check valve through which the sub-chamber communicates with the ink supply port is offset disposed in the sidewall of the cartridge body adjacent to the ink supply port. The ink supply chamber formed between the check valve and the ink supply port has a passage used for relieving pressure to the ink chamber. A check decompression valve used to generate negative pressure in the ink supply chamber during filling ink is provided at the port of the passage.

As seen from the above technical solution, when a certain amount of ink in the ink supply port has been consumed, pressure at the outlet of the check valve will be lower than that at the inlet of it, as a result of which the check valve will be opened and ink will flow from the ink chamber through the check valve to the ink supply port. When pressure at two ends of the check valve becomes equal to each other increasingly, the check valve will close automatically. Air come from an air passage and introduced into the ink chamber will balance out the negative pressure generated as ink in the ink chamber is flowing out, therefore remaining a substantially constant pressure in the ink chamber and ensuring a normal ink supply to the printer. Because the sponge has been eliminated, accordingly the volume of the ink chamber increases. The ink quantity contained in the ink cartridge may increase 30–60%.

The present invention employs such a design that there are two chambers, which are a main chamber and a sub-chamber. When ink in the main chamber has been exhausted completely, an ink-out detecting device will send an ink-out indicative signal. At this time, the users may consider whether the printing operation is continued by means of the ink stored in the sub-chamber or not, depending on the actual requirement for printing.

Because the centerline of the valve body is coincident with the moving direction of the print head in the disposing mode employed, the valve body will be subject to the inertia force in axial direction of it. The diameter of the valve body is relatively small, and then the bearing area of it is also small. In addition to these, the valve body has a certain thickness. Because of the reason illustrated above, the action applied by the inertia force will not give any disadvantageous influence to the open and close function of the valve. For the periphery size of the check valve assembly is larger than the axial size of it, when employing the solution in which the check valve is offset disposed, it is possible to place the check valve into a narrow ink cartridge. In this case, what is needed to consider is only the manufacturing process. This will be further explained in the embodiments of the present invention hereafter.

Because of the check valve disposed between the ink supply chamber and the ink chamber, ink dropping occurred when placing the ink cartridge onto the printer, which is equipped with an ink supply needle or the similar component thereof, may be prevented effectively. In the meanwhile, air in the ink chamber and the ink supply chamber may be easily drawn out during the manufacturing process of the ink cartridge to form a negative region, as a result of which the operation for filling the ink chamber and the ink supply chamber with ink may complete at a time during the ink filling step subsequently.

DESCRIPTION OF THE PREFERRED EMBODIMENTS

Hereinafter, the present invention will be further described in detail in combination with some embodiments and the attached drawings.

Figure 1:
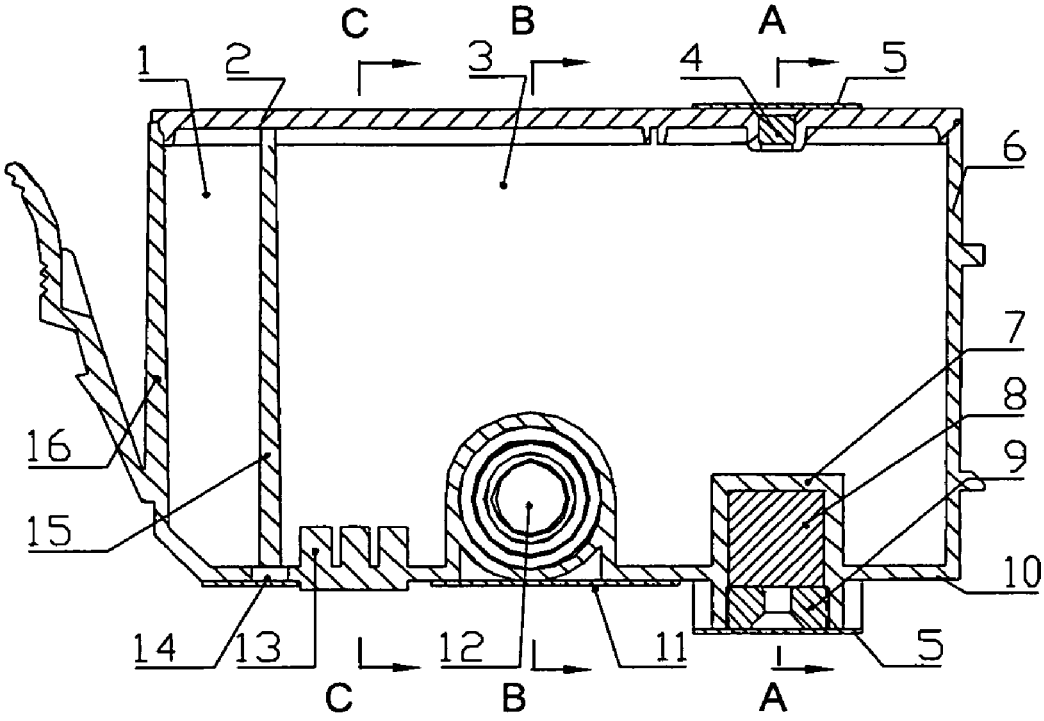
FIG. 1 is a structural diagram according to the first embodiment of the invention.

Embodiment 1:

Referring to FIG. 1, this embodiment provides such a technical solution that an ink chamber is divided into a main chamber and a sub-chamber theoretically. The ink chamber is enclosed with a cap 2, two end walls 6 and 16, a bottom surface 10 and two side walls. A vertical partition wall 15 separates a main chamber 3 to form a sub-chamber 1, which is substantially sealed. "Substantially sealed" means that at the bottom of this chamber 1, there is only one through hole 14, adjacent to which an ink-out detecting prism 13 is provided. The inlet of a check valve chamber 12 is communicated with a passage, which is used for supplying ink from the sub-chamber and formed between an outer groove on the cartridge body and a sealing membrane that seals a process hole on the check valve chamber 12. The outlet of the check valve chamber 12 is communicated with an ink supply port 7, at the upper end of which an ink-guiding member 8 made of fibrous material is provided, and at the lower end of which a sealing ring 9 that takes a flared shape near its outlet is provided. The sealing ring 9, at the outermost end of which a sealing membrane 5 is provided, hermetically contacts with an ink supply boss on the printer through a loop line. On the cap 2 there is an air passage, which is formed by a hole and an air permeable plug 4 used to clog the hole. The plug 4 made of high molecular material is a column in which air holes are formed. The diameter of the air hole is ranged from 10 μm to 60 μm. This air passage may supply air to the ink chamber so as to keep a constant pressure, and also may ensure that ink liquid cannot flow out from it when the ink cartridge is taken out during use, as a result of which the printer or the operator will be polluted. Also, the air permeable plug 4 is sealed with a sealing membrane 5.

Figure 2:
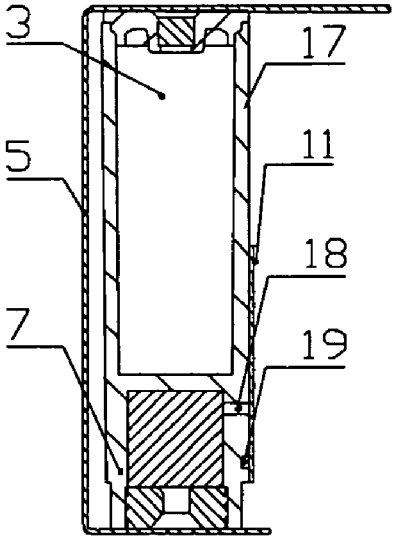
FIG. 2 is a sectional view along line A—A in FIG. 1.

Referring to FIG. 2, the ink supply port 7 and the air passage are sealed with the sealing membrane 5, which is to be peeled off when starting using the ink cartridge. Out of the side wall 17 of the cartridge body, there are an ink passage 18 that communicates the outlet of the check valve chamber with the ink supply port 7, and an ink passage 19 that communicates two areas separated by the ink supply port 7 at the lower part of the main chamber 3. The sealing membrane 11 is also used to seal the groove constituting the ink passages 18, 19.

Figure 3:
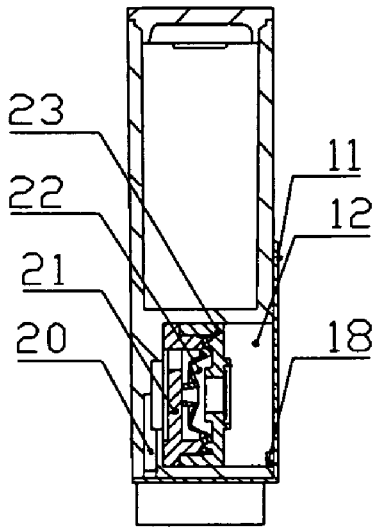
FIG. 3 is a sectional view along line B—B in FIG. 1.

Referring to FIG. 3, an ink inletting passage 20 communicated with the ink chamber is provided at the left side of the check valve chamber 12, and at the right and lower part of it, an ink outlet passage 18 is provided. The valve is comprised of a left body 21, a right body 23 and a valve body 22 between them. The valve port of the valve body 22 made of an elastic material elastically presses against the valve face of the left body, on the surface of which a hole is provided. There is a hole on the middle part of the right body 23. After having been fitted together, the left and right bodies will hermetically cooperate with the check valve chamber. The sealing membrane 11 seals the process hole of the check valve chamber 12 and the grooves constituting each ink passage.

Figure 4:
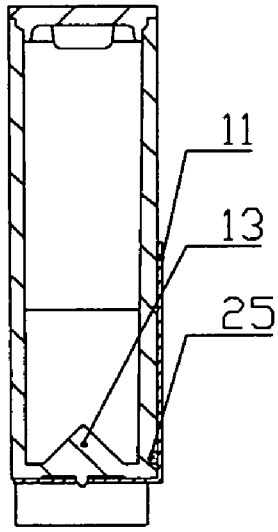
FIG. 4 is a sectional view along line C—C in FIG. 1.

Referring to FIG. 4, the sealing membrane 11 seals an ink passage 25 communicating the sub-chamber with the check valve chamber.

Figure 5:
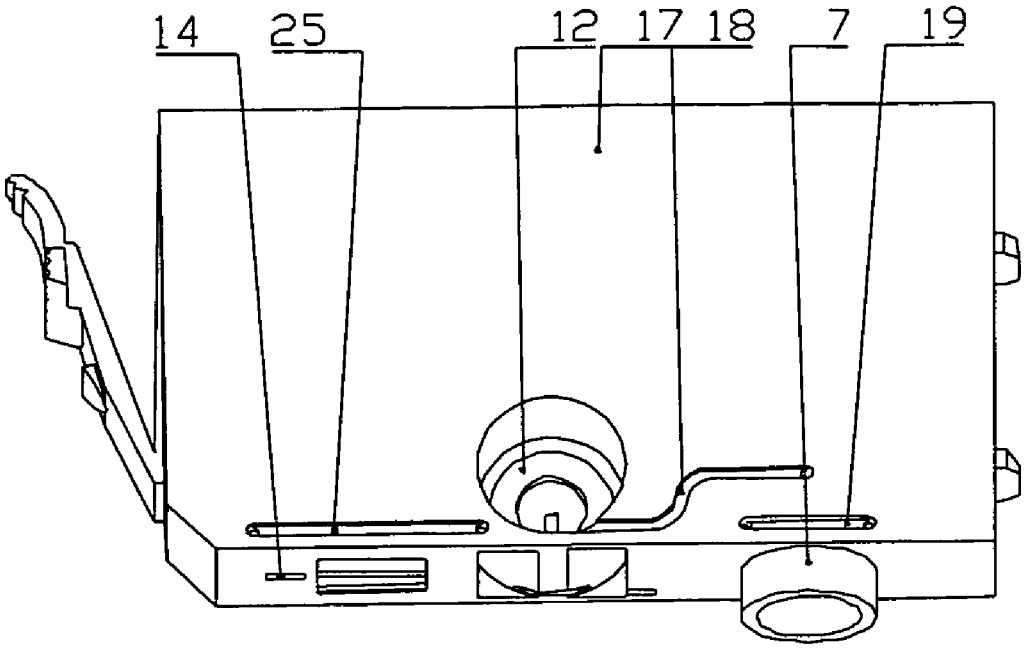
FIG. 5 is a three-dimensional diagram showing the cartridge body according to the first embodiment.

Referring to FIG. 5, on the side wall 17 of the cartridge body, there are an ink passage 25 communicating the sub-chamber with the check valve chamber 12, an ink passage 18 communicating the check valve chamber 12 with the ink supply port, and an ink passage 19 communicating two lower parts of the main chamber separated by the ink supply port. A through hole 14 between the main chamber and the auxiliary one is disposed on the bottom of the cartridge body.

Figure 6:
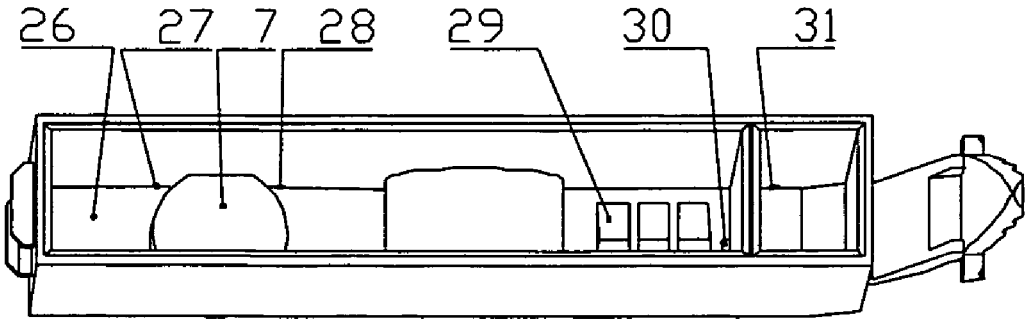
FIG. 6 is a three-dimensional diagram showing the cartridge body according to the first embodiment, seen from another direction.

Referring to FIG. 6, the interval between two sidewalls 17 of the cartridge body is extremely narrow and the ink supply port 7 has a certain height in the main chamber, thus a lower region 26 is formed. In order that there is not any ink left in this region, the holes 27, 28 communicating with the ink passage 19 are provided in the main chamber, a hole 31 communicating with the ink passage 25 and a through hole 30(14) are provided in the sub-chamber. The ink-out detecting prism 29 is designed to have such a structure and shape that there are slots in it, the purpose of which is to prevent the mirror surface of the detecting prism from being shrunk, resulted from the contraction during injection mold.

Figure 7:
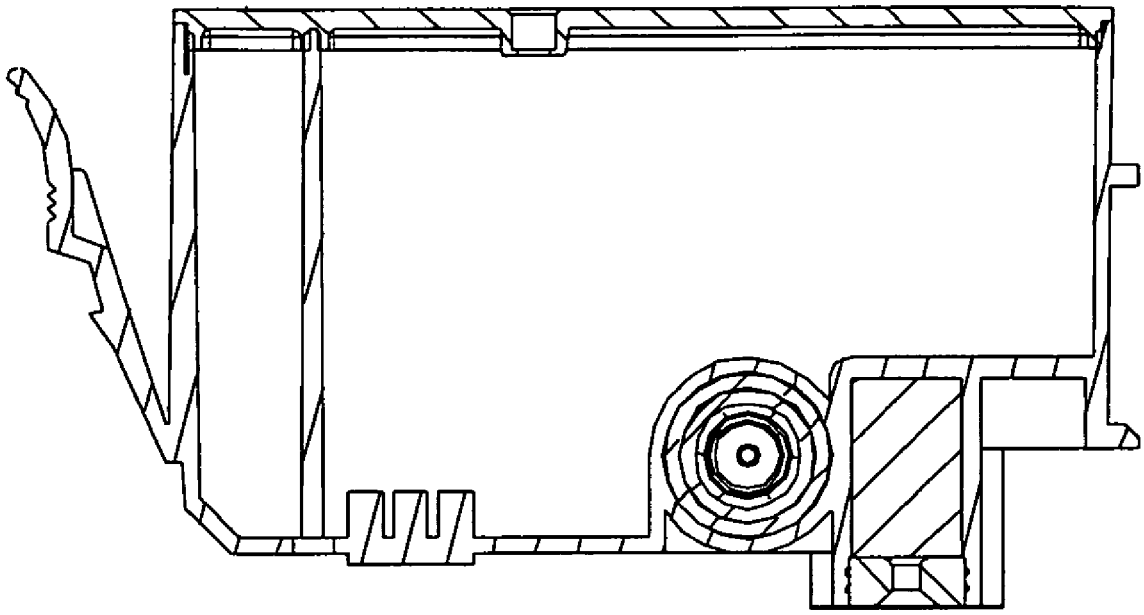
FIG. 7 is a structural diagram according to the second embodiment.

Embodiment 2:

Referring to FIG. 7, this embodiment is substantially the same as the first embodiment only except that the bottom surface of the main chamber is partially raised to a location that approximately flushes with the top surface of the check valve chamber, as a result of which the lower region 26 in the main chamber (seen in FIG. 6) may be eliminated. Accordingly, the ink passage 19 used to communicate with this lower region may be eliminated, and the ink passage 25 is still the only passage leading to the inlet end of the check valve chamber. Therefore, the structure may be simplified, and the steps for manufacturing the ink cartridge may be reduced.

Embodiment 3:

In each figure of this embodiment, the like reference numerals are used for like elements as the first embodiment.

Figure 8:
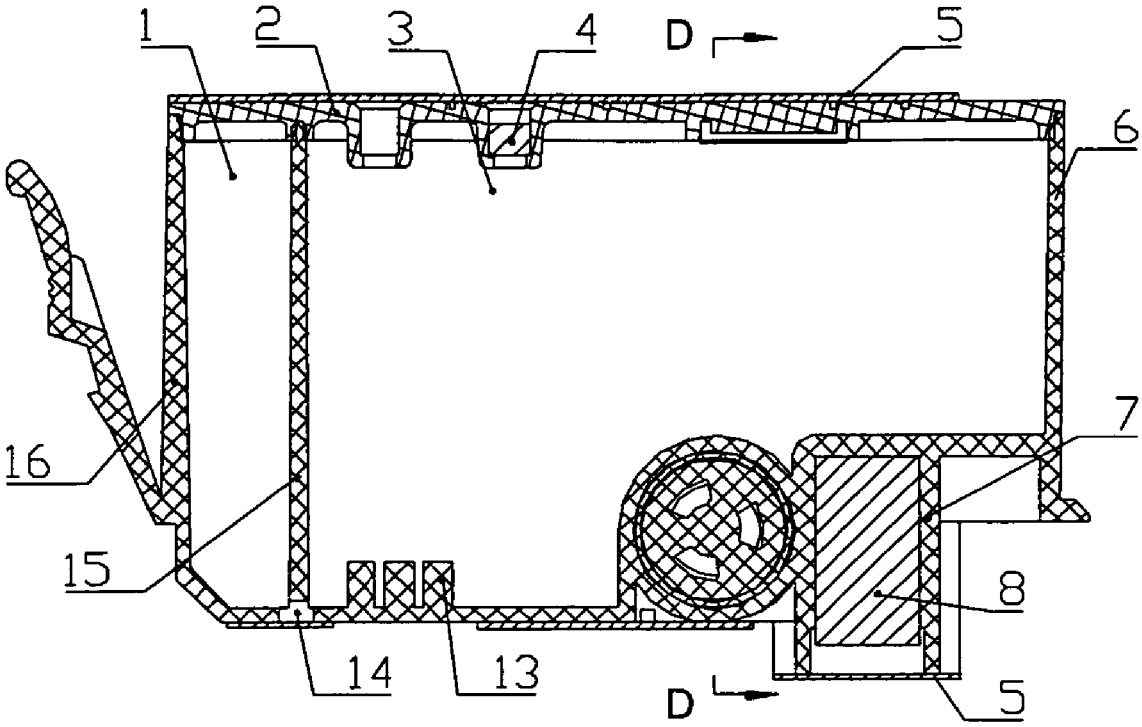
FIG. 8 is a structural diagram according to the third embodiment.
Figure 9:
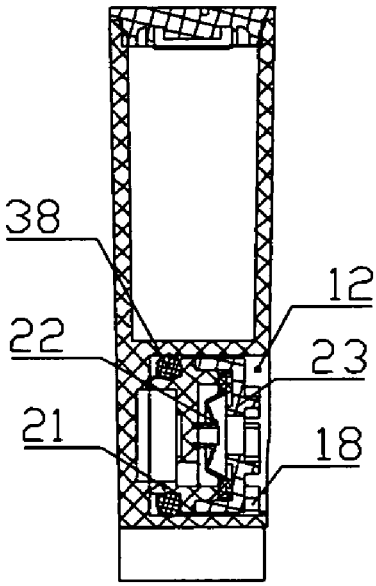
FIG. 9 is a sectional view along line D—D in FIG. 8.
Figure 10:
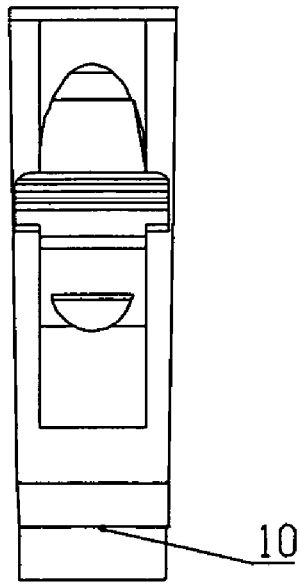
FIG. 10 is a left view of FIG. 8.

With respective to some types of the printers, in which a photoelectric device used for detecting whether ink is exhausted has a relatively high precision, and the ink cartridge holder of the print head mates with the ink cartridge accurately, referring to FIG. 8, FIG. 9 and FIG. 10, the sealing ring around the ink supply port 7 may be eliminated, accordingly, ink supply is achieved by a direct contact between the ink-guiding member 8 and the print head.

Furthermore, referring to FIG. 9, in this embodiment, sealing rings 38 made of rubber are pressed into the space between the left body 21 of the check valve and the inner wall of the check valve chamber 12, therefore it is unnecessary to adhere the valve assembly, which is comprised of the left body 21, the right body 23 and the valve body 22, to the inner wall of the check valve chamber 12. Accordingly, an improved assembling manufacturability may be obtained compared with the previous embodiments, and the sealing quality here is easier to be ensured.

Figure 11:
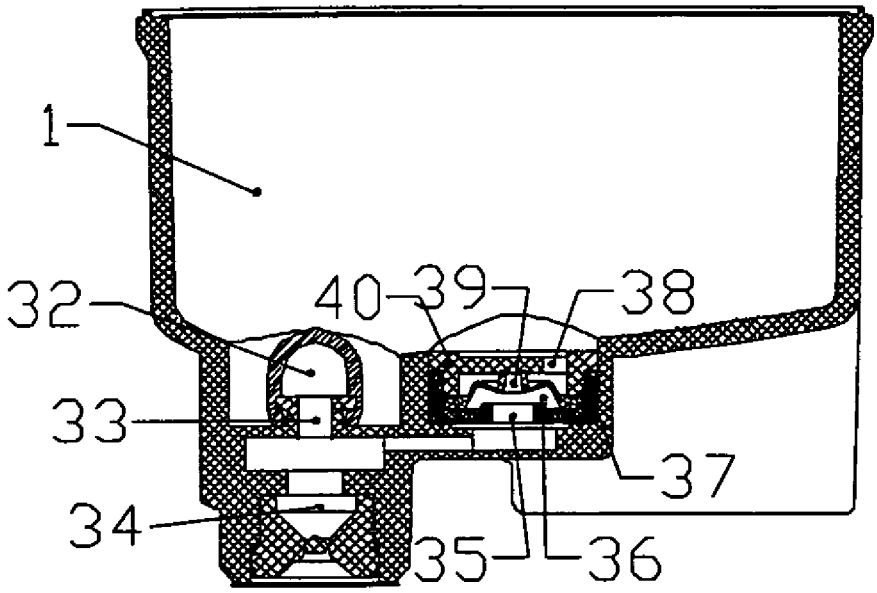
FIG. 11 is a structural diagram according to the fourth embodiment, in which the cap of the cartridge has been removed.
Figure 12:
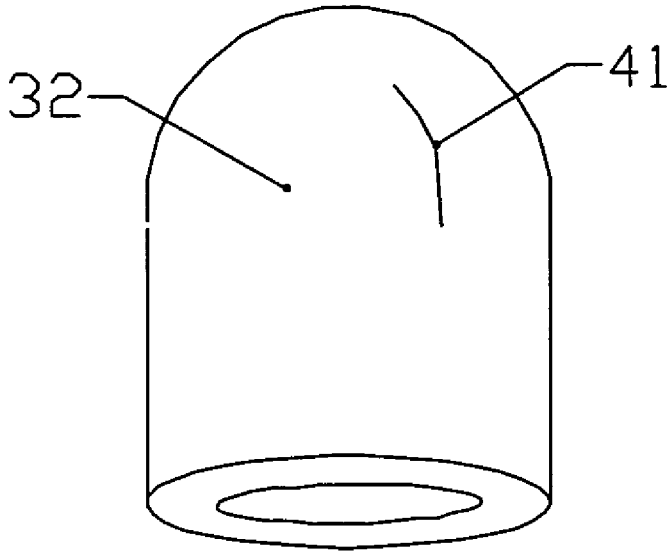
FIG. 12 is a structural diagram showing a check decompression valve according to the fourth embodiment.

Embodiment 4:

Referring to FIG. 11 and FIG. 12, a check valve is provided between the ink chamber 1 and the ink supply port. This check valve is made up of a base nest 37 having a through hole 35, a valve core having a center hole 39 and a capping 40 having a through hole 38. The valve core 36 made of elastic material presses the head part of the center hole 39 against the valve face of the capping 40 by its elasticity. The ink supply chamber 34 is a space between the valve face and the sealing member. There is a decompression passage 33 between the ink chamber 1 and the ink supply chamber 34. A check decompression valve 32 fitted on the passage 33 is a tube-like body having elasticity, the open end of which hermetically and fixedly connects with the passage 33. In the wall of the tube-like body there is a cut 41, which extends from the outer side of the tube-like body to the inner side of it and may be elastically closed by itself. Because the inner chamber of the tube-like body communicates with the ink supply chamber and the outer wall of it is located in the ink chamber, when pressure in the ink supply chamber is higher than that in the ink chamber and the pressure difference between them comes to a threshold valve, the slot 41 will be open to allow the ink liquid in the ink supply chamber to flow back into the ink chamber, therefore pressure in the ink supply chamber may be relieved. When pressures in both chambers are equal to each other, the slot 41 will remain closed by means of the elastic force itself. When pressure in the ink chamber is higher than that in the ink supply chamber, because the structure of the tube-like body has a compression resistance, a tangential force created in the wall of the tube will cause the slot to be more tightly closed. This embodiment is also suitable to adopt the negative pressure ink-filling method during manufacturing the ink cartridge, by which method the ink supply chamber 34 can be filled under the negative pressure.

Figure 13:
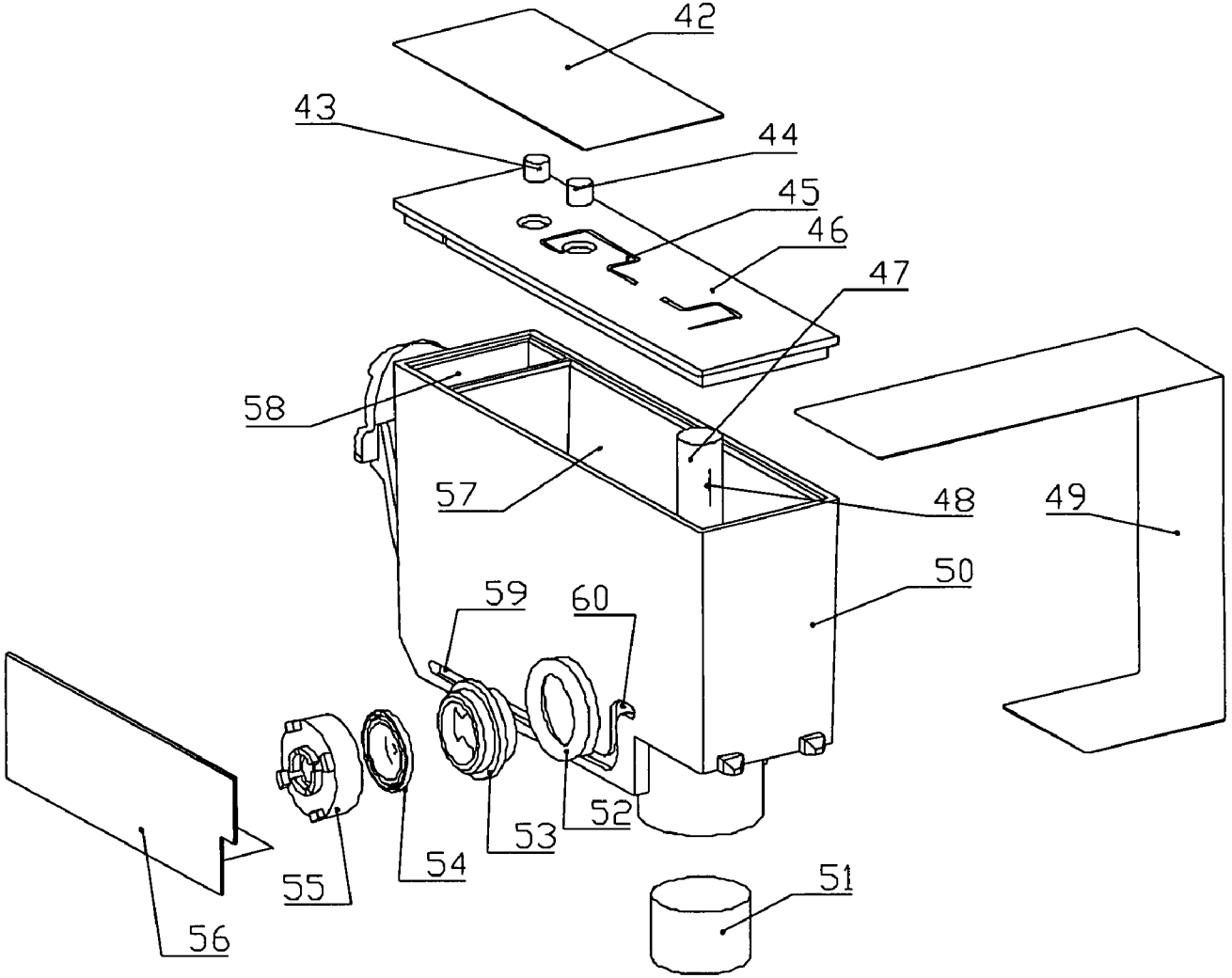
FIG. 13 is a structural diagram according to the fifth embodiment.

Embodiment 5:

This embodiment is the optimum embodiment of the present invention. Referring to FIG. 13, an air slot 45 communicating with atmosphere is provided on the cap 46 of the cartridge. When using the ink cartridge, the air slot may introduce air into an air hole that is plugged by an air permeable plug 44 and then into a main chamber 57. A process hole used for filling ink and a sealing member 43 used for sealing the process hole are formed near a sub-chamber 58. A membrane 42 fixed on the cap permanently forms an air passage with the air slot 45. The upper and lower parts of the membrane 42, which is peeled off when putting the ink cartridge onto a printer and starting printing, seal the termination point of the air passage and the ink supply port respectively. A partition wall divides the cartridge body 50 into a main chamber 57 and a sub-chamber 58, which are communicated with each other through a hole at the bottom. The sub-chamber 58 is communicated with the inlet of a check valve through an ink channel 59, while the outlet of the check valve leads to the ink supply port, in which an ink-guiding member 51 is disposed, through an ink channel 60. The check valve assembly comprised of a left body 55, a valve core 54 and a right body 53 is pressed into a valve nest 61 on the side of the cartridge body 50 through an O-ring 52. One side of a L-shaped membrane 56 seals the valve nest, the ink channel 59 and the ink channel 60, while another side of it seals the channel that is extended from the ink channel 59 on the bottom. The open end of a check decompression valve 47, which has a slot 48, is put on a communicating tube 62 between the ink supply chamber and the ink chamber.

Figure 14:
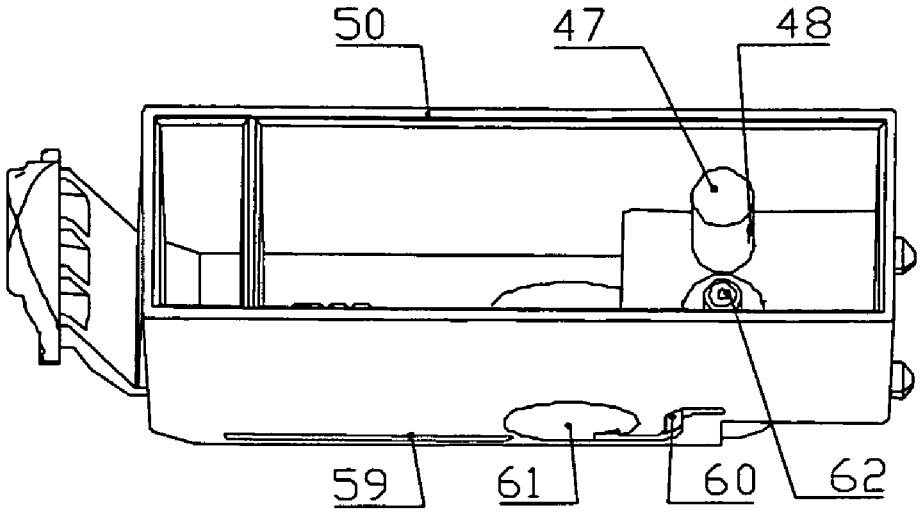
FIG. 14 is a three-dimensional diagram showing the cartridge body according to the fifth embodiment.

Referring to FIG. 14, the right side of the ink channel 59 extends at the bottom part of the cartridge body, and into the inlet end of the check valve on the valve nest 61. The right side of the ink channel 60 leads into the ink supply chamber. The open end of the check decompression valve 47, which is made of an elastic material and has a slot 48, is tightly put on the communicating tube 62.

Figure 15:
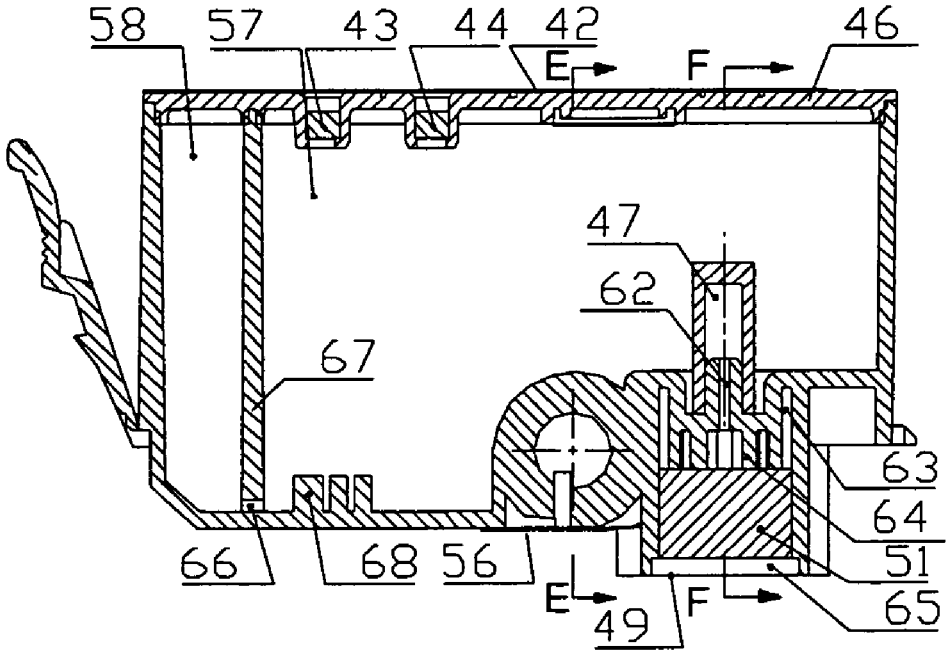
FIG. 15 is a sectional view according to the fifth embodiment.

Referring to FIG. 15, the sub-chamber 58 and the main chamber 57 are separated from each other by a partition wall 67. The sub-chamber 58 is substantially sealed except a hole 66 communicating with the main chamber 57 on the bottom and a hole leading to the ink channel 59. The space above the ink supply port 75 is an ink supply chamber 63, in which a decompression passage leading to the ink chamber is disposed. The check decompression valve 47 is put on the tube 62 of the decompression passage. In addition, there are vertical split bars 64 and an ink-guiding member 51 in the ink supply chamber 63. This allows the top surface of the ink-guiding member 51 to be located in an ink fully filled environment, and also allows the location where an inlet hole of the ink channel 60 is disposed to be higher than the top surface of the ink-guiding member 51.

Figure 16:
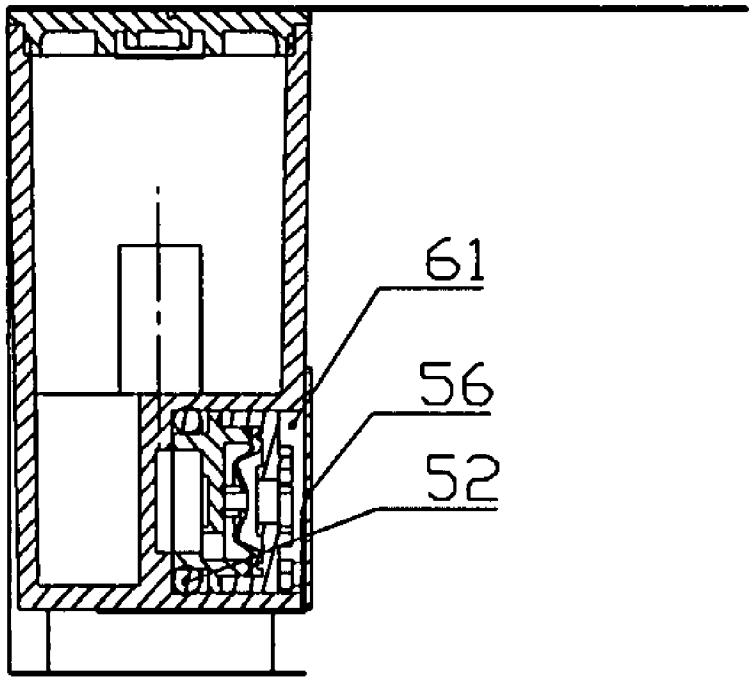
FIG. 16 is a sectional view along line E—E in FIG. 15.

Referring to FIG. 16, the valve nest 61 that the check valve assembly is disposed in is a concave region on one sidewall of the cartridge body. The inlet end (left side) and the outlet end (right side) of the valve are separated from each other by the O-rings 52 on the outside of the check valve assembly. A membrane 56 seals the valve nest.

Figure 17:
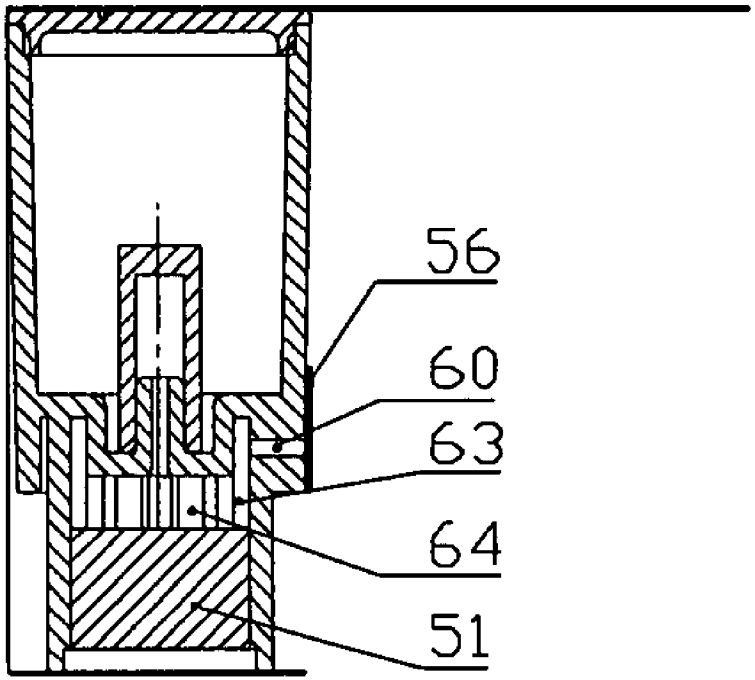
FIG. 17 is a sectional view along line F—F in FIG. 15.

Referring to FIG. 17, the membrane 56 seals a part of the ink channel 60 on the out wall of the cartridge body. This part of the ink channel 60 forms an ink passage, one end of which leads to the ink supply chamber 63. The split bars 64 at the upper part of the ink supply chamber 63 presses against the top surface of the ink-guiding member 51.

Hereafter, the ink filling method by means of drawing in the negative pressure during manufacturing process and the operating principle of the present invention will be described briefly. After slipping the elastic sealing member 43, into the process hole, and slipping the elastic air permeable plug 44 into a corresponding hole on the cap 46, the cap 46 is sealed by the membrane 42. The membrane 56 seals the valve nest and the ink channel formed on the outside wall. The upper part of the membrane 49 seals the air hole, while the lower part of it seals the ink supply port 65. Accordingly, the main chamber 57, the sub-chamber 58 and the ink supply chamber 63 may be sealed completely. Then, the needle of a negative pressure ink-filling device penetrates into the main chamber 57 through the sealing member 43 to draw air out of the main chamber. Because the sub-chamber 58 communicates with the main chamber 57 through the communicating hole 66, air in both chambers will be drawn out firstly. At this time, the ink supply chamber will be in a positive pressure state relative to the two chambers above, and the check valve will be tightly closed under the positive pressure. However, for the internal pressure of the check decompression valve 47 is higher than the external pressure of it, the valve tube made of an elastic material will expand in the radial direction of it, as a result of which the slot will be opened. Then, the ink supply chamber is also in a negative pressure state. At this time, ink may be easily filled into the main chamber, the sub-chamber and the ink supply chamber. When placing this ink cartridge filled with ink onto the printer and starting using it, the membrane 49 will be peeled off, so as to allow the main chamber 57 to communicate with atmosphere, and the ink-guiding member 51 to contact with the print head. Ink in the ink supply chamber will reduce in accompany with the printing, and then the ink supply chamber 63 will be in a negative pressure state relative to the main and sub-chambers. At this time, the external pressure of the check decompression valve 47 made of an elastic material will be higher than the internal pressure of it, making the valve tube contract in the radial direction, as a result of which the check valve will be opened and ink will be supplied from the sub-chamber 58 into the ink supply chamber 63. Because the sub-chamber 58 is sealed substantially, ink having been consumed will be compensated by ink coming from the main chamber 57; in the meanwhile, air will be supplied into the main chamber 57 through the air passage on the cap. When ink in the main chamber is exhausted, the ink-out detecting prism 68 located on the bottom of the main chamber will send an ink-out indicative signal to the printer. However, at this time, the printing operation may continue by means of the ink stored in the sub-chamber 58. The passage 66 becomes an air passage used for supplying air into the sub-chamber 58.

Figure 18:
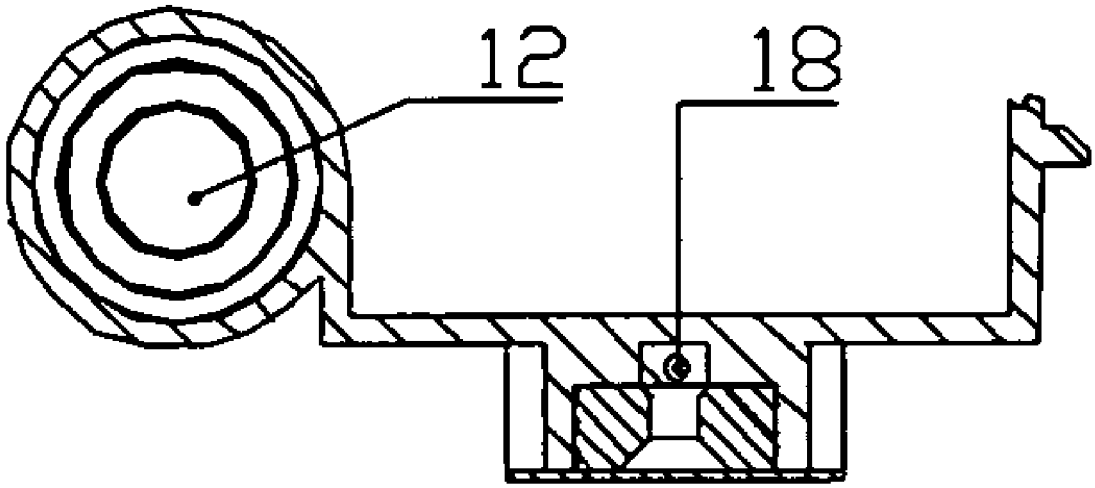
FIG. 18 is a view showing another structural form of the ink supply port that may be used in the embodiments.

The present invention is not limited to the five embodiments described above. The structure of the present invention may be further simplified based on the above embodiments. Referring to FIG. 18, in most circumstances, after having been placed onto the printer, the ink cartridge will not be taken out and discarded until ink in it has been exhausted. It is scarcely occurred that taking out the ink cartridge and replacing it onto the printer again in the middle course of the printing operation. Therefore, the solution shown in FIG. 18 eliminates the ink-guiding member in the ink supply port 7. In order to achieve it, what is needed is only to move one end of the ink channel 18, which is near the outlet of the check valve chamber 12, to the upper side of the sealing ring. In fact, because the size of the ink channel's section is extremely small and the surface of the ink presents a surface tension, as long as not throwing and squeezing the ink cartridge forcibly when the ink cartridge is being taken out in the middle course of the printing operation, there is not any apparent difference between having and not having the ink-guiding member.

INDUSTRY UTILITY

The ink cartridge for printer provided by the present invention replaces the porous material with a check valve to control the ink supply, accordingly ink volume in the ink cartridge may be increased. And the present invention employs a structure form made up of a main chamber and a sub-chamber, accordingly, even the printer has sent an ink-out indicative signal, the ink left in the ink cartridge may be supplied to the printer to continue the printing operation. The solution in which the check valve is offset disposed may improve the manufacturability and the ink supply stability. Employing the check valve may prevent ink from dropping out when placing the ink cartridge onto the printer, and improve the filling manufacturability during the manufacturing process.

The invention claimed is:

1. An ink cartridge for a printer comprising:

a cartridge body having an ink chamber, an ink supply port and an air passage, wherein the ink chamber is comprised of a main chamber and a sub-chamber communicated with each other, an ink-out detecting prism is disposed adjacent to a communicating part between the main chamber and the sub-chamber, a check valve is offset disposed in the side wall of a cartridge body adjacent to the ink supply port, and the sub-chamber communicates with the ink supply port through the check valve.

2. The ink cartridge for a printer according to claim 1, wherein a partition wall is provided between said main chamber and said sub-chamber, the communicating part between said main chamber and said sub-chamber is a communicating hole provided at a bottom, and the location of said communicating hole is lower than a refracting point of said ink-out detecting prism.

3. The ink cartridge for a printer according to claim 2, wherein said sub-chamber is completely sealed except said communicating hole.

4. The ink cartridge for a printer according to the claim 1, wherein an ink-guiding member is further disposed in said ink supply port.

5. The ink cartridge for a printer according to claim 1, wherein an ink supply chamber is formed between said check valve and said ink supply port.

6. The ink cartridge for a printer according to claim 5, wherein said ink supply chamber further comprises a passage for relieving pressure to said main chamber, and a check decompression valve used to generate negative pressure in said ink supply chamber during ink filling, the check decompression valve provided at the port of the passage.

7. The ink cartridge for a printer according to claim 6, wherein the check decompression valve is comprised of an elastic wall connected with said passage, and a slot is formed on the wall of the check decompression valve.

8. The ink cartridge for a printer according to claim 7, wherein a internal side of the elastic wall communicates with said ink supply chamber, and a external side of the elastic wall is located in said ink chamber.

9. The ink cartridge for a printer according to claim 7, wherein the elastic wall is a cylindrical tube, and a direction in which a length of the slot extends is parallel with the axis of the cylindrical tube.

10. The ink cartridge for a printer according to claim 1, wherein said sub-chamber is completely sealed except said communicating hole.

11. An ink cartridge for a printer comprising:

a cartridge body having an ink chamber, an ink supply port, and an air passage;

the ink chamber including a main chamber, a sub-chamber, and an air passage hole;

the main chamber including a check valve;

means for supplying ink from the main chamber and sub-chamber, to the check valve;

means for supplying ink from the check valve to the ink supply port; and means for the air passage hole to supply air to the ink chamber for maintaining a constant pressure inside the ink chamber.

12. The ink cartridge for a printer according to claim 11, further comprising:

means for detecting the ink contained within the ink chamber is low.

13. The ink cartridge for a printer according to claim 12, further comprising:

means for decompressing a passage from the ink chamber to the ink supply port.

14. The ink cartridge for a printer according to claim 13, further comprising:

means for guiding ink within the ink supply port.

15. The ink cartridge for a printer according to claim 14, further comprising:

means for sealing the ink cartridge for ink filling.

16. The ink cartridge for a printer according to claim 15, further comprising:

means for relieving pressure to said main chamber; and means for generating negative pressure in said ink supply chamber during ink filling.

17. The ink cartridge for a printer according to claim 16, further comprising:

a print head;

means for connecting the ink cartridge to the print head; and means for removing said means for sealing the ink cartridge, before connecting the print cartridge to the print head.

* * * * *